United States Patent [19]

Hirtz

[11] Patent Number: 4,661,459

[45] Date of Patent: Apr. 28, 1987

[54] CONTINUOUS GAS/STEAM MONITOR

[75] Inventor: Paul N. Hirtz, Santa Rosa, Calif.

[73] Assignee: GEO Operator Corporation, Santa Rosa, Calif.

[21] Appl. No.: 816,177

[22] Filed: Jan. 6, 1986

[51] Int. Cl.[4] ..... G01N 33/24

[52] U.S. Cl. ..... 436/25; 55/73; 73/23; 422/83; 436/38; 436/177

[58] Field of Search ..... 55/52, 73; 203/3; 73/23; 422/83; 436/25, 29, 30, 33, 38, 177, 181

[56] References Cited

U.S. PATENT DOCUMENTS

| | | | |
|---|---|---|---|
| 4,259,300 | 3/1981 | Lieffers | 423/224 |
| 4,260,461 | 4/1981 | Pottharst, Jr. | 203/7 |
| 4,319,895 | 3/1982 | Kemmer | 55/73 |
| 4,355,997 | 10/1982 | Smith et al. | 436/25 |
| 4,402,910 | 9/1983 | Smith et al. | 422/83 |
| 4,410,432 | 10/1983 | Domahidy | 210/750 |

*Primary Examiner*—Charles Hart

*Attorney, Agent, or Firm*—Townsend and Townsend

[57] ABSTRACT

A continuous gas/steam ratio monitor is disclosed for use with a geothermal fluid source. A sample of the geothermal well steam flow is mechanically separated to eliminate condensate and treated with sulfuric acid to a pH between 3.0 and 5.0 to prevent $H_2S$ and $CO_2$ from dissolving into solution. Discharge of the steam occurs to a separating reservoir and then to a vertical condenser column having a lower condensate pool and an upper gas discharge outlet. The vertical condenser at its cooling fluid end is connected to an atmospheric heat exchanger to condense the steam close to the boiling temperature of water at the operating pressure (about 20–25 inches of mercury). Thus the condensate has the maximum tendency to liberate dissolved noncondensible gases. The upper discharge end of the column is cooled by a refrigeration unit and is kept close to the freezing point of water (about 33° F.). Thus, most of the water vapor mixed in the gas is removed. The dry discharged gas is then measured at a mass flow meter. This dry gas discharge is thus prepared for analysis by a gas chromatograph or other analytical instrument. The steam condensate drains from the lower condensate pool to a level chamber equipped with an electronic float switch. When the chamber is full of condensate, the float switch triggers a pump to eject the liquid. A microcomputer measures the time elapsed between pump charges and calculates the condensate flow rate. The ratio of condensate flow to gas mass flow is taken in the noncondensible gases present and the steam flow accurately measured.

8 Claims, 1 Drawing Figure

CONTINUOUS GAS/STEAM MONITOR

BACKGROUND OF THE INVENTION

This invention relates to geothermal fluids and in particular to an apparatus for measuring noncondensible gas flow relative to steam flow in such fluids.

Geothermal fluids contain noncondensible gases. The concentrations of such noncondensible gases in geothermal fluids produced through geothermal wells vary. These gases can include hydrogen sulfide, carbon dioxide, ammonia and other gases some of which may appear as so-called pollutants when discharged to the atmosphere in quantity. The ratio of noncondensible gases to steam is an important parameter in geothermal reservoir evaluation, resource management, power plant design and operation, and compliance with environmental regulations.

For example, where such geothermal fluid is being used in combination with a turbine exhausted to a condenser, the presence and concentration of noncondensible gases in the flow creates a gas discharge problem which must be specifically met. In order to realize efficiency, turbine exhaust to a condenser from geothermal fluids must be below atmospheric pressure. Consequently, noncondensible gases must be ejected from below atmospheric pressure. Moreover, gas ejection equipment must be precisely sized and designed.

Where gas is encountered above that level for which ejection equipment is designed, the temperature in the condenser rises, back pressure in the condenser likewise rises and the load can be lost.

Conversely, where gas is present at a level below the design of noncondensible gas ejection equipment, steam in the low pressure turbine can go to sonic levels. When this occurs, the temperature then rises with loss of efficiency and danger of loss of load.

Furthermore, the presence and kind of noncondensible gases must be known. Specifically, and where a geothermal plant "starts up," provision must be made to eject the gases during the start up. Moreover, since some of the gases present are rated as atmospheric pollutants, accurate measurement of their presence is now required by regulation. Obtaining and maintaining an accurate measurement of the gases present is necessary to determine what type and quantity of treatment should be rendered to the gas.

Additionally knowledge of the presence and kind of noncondensible gases in geothermal fluids from individual wells is essential for the evaluation and management of a geothermal reservoir. Noncondensible gas/steam ratios and noncondensible gas composition are used, with other information, to determine reservoir temperatures and fluid reserves, as components in physiochemical reservoir modeling, to plan resource exploitation to comply with environmental regulations and power plant design limitations, and for other important operations in reservoir evaluation and management.

SUMMARY OF THE RELATED ART

Previous devices, such as so called "wet test meters" and "bubble test" devices do not provide a means for unattended continuous recording of gas/steam ratio. Consequently as on-line flow meters, such devices are unsatisfactory due to this failure to accurately and continuously measure and record gas/steam ratios.

For example, the measurements of noncondensible gases by previous devices of times include unknown amounts of steam. This being the case, accurate measurement of the noncondensible gases present by the techniques used in such devices is not possible.

Likewise, when condensate is discharged from such devices, large amounts of dissolved noncondensible gases could be present. Again error can result.

In addition, these previous devices do not provide a means for continuously analyzing the composition of the noncondensible gases in the geothermal fluid.

Many devices include the treating of steam to establish a pH between 3.0 and 5.0 to liberate $H_2S$ and $CO_2$. See for example Domahidy U.S. Pat. No. 4,410,432, Lieffers U.S. Pat. No. 4,259,300, Kemmer U.S. Pat. No. 4,319,895, Pottharst, Jr. U.S. Pat. No. 4,260,461 and Smith et al. U.S. Pat. No. 4,355,997.

SUMMARY OF THE INVENTION

A continuous gas/steam ratio monitor is disclosed for use with a geothermal fluid source. A sample of the geothermal well steam flow is mechanically separated to eliminate condensate and treated with sulfuric acid to a pH between 3.0 and 5.0 to prevent $H_2S$ and $CO_2$ from dissolving into condensate. Discharge of the steam occurs to a separating reservoir and then to a vertical condenser column having a lower condensate pool and an upper gas discharge outlet. The vertical condenser at its cooling fluid end is connected to an atmospheric heat exchanger to condense the steam close to the boiling temperature of water at the operating pressure (about minus 20–25 inches of mercury). Thus the condensate has the maximum tendency to liberate dissolved noncondensible gases. The upper discharge end of the column is cooled by a refrigeration unit and is kept close to the freezing point of water (about 33° F.). Gas is withdrawn to the suction side of a vacuum pump. Thus, most of the water vapor mixed in the gas is substantially removed. The dry discharged gas is then measured at a mass flow meter. The dry gas discharge is appropriately conditioned for compositional analysis by gas chromatograph or other analytical device. The steam condensate drains from the lower condensate pool to a level chamber equipped with an electronic float switch. When the chamber is full of condensate, the float switch triggers a pump to eject the liquid. A microcomputer measures the time elapsed between pump charges and calculates the condensate flow rate. The volumetric ratio of gas/steam calculated from accurate measurements of gas flow and condensate flow is taken as an accurate measurement of the noncondensible gases present in the steam flow.

OTHER OBJECTS AND ADVANTAGES

An object of this invention is to sample noncondensible gases continuously in the flow of geothermal steam. According to this aspect, gases are pulled by a vacuum pump from a hot condensate well (having maximum tendency to discharge dissolved gases from the condensate) and through a refrigerated column (having maximum tendency to condense water vapor). A substantially continuous on-line measure of noncondensible gas relative to condensate occurs.

Yet another object of this invention is to measure condensate outflow accurately. Accordingly, there is provided a reservoir. The reservoir is equipped with two level sensors. When the reservoir reaches the upper level sensor, a positive displacement pump evacuates the reservoir. The evacuation provided by this pump is compared to the gas flow to produce the desired ratio. Typically, the condensate is chemically treated to liberate all gases save and except chemically basic gases (ammonia—$NH_3$).

An advantage of this invention is the production of a water free noncondensible gas stream, at a known original gas/steam ratio. The water free noncondensible gas stream is suitable for analysis by gas chromatograph or other analytical instrument. The known gas/steam ratio allows the analyzed gas concentrations of each gas to be determined relative to steam.

Other objects, features and advantages of this invention will become more apparent after referring to the following specification and attached drawings.

BRIEF DESCRIPTION OF THE DRAWINGS

Referring to FIG. 1, a main steam flow gas line 14 is only partially shown having a sample line 16 with valve 17 continuously discharging a small sample flow of steam. The steam passes through a separator apparatus A which here comprises a T-joint 18. The majority of the steam flow passes at jet 19 to atmosphere. A small steam sample passes through line 20 and needle valve 26 into the separator chamber B.

Figure 1:
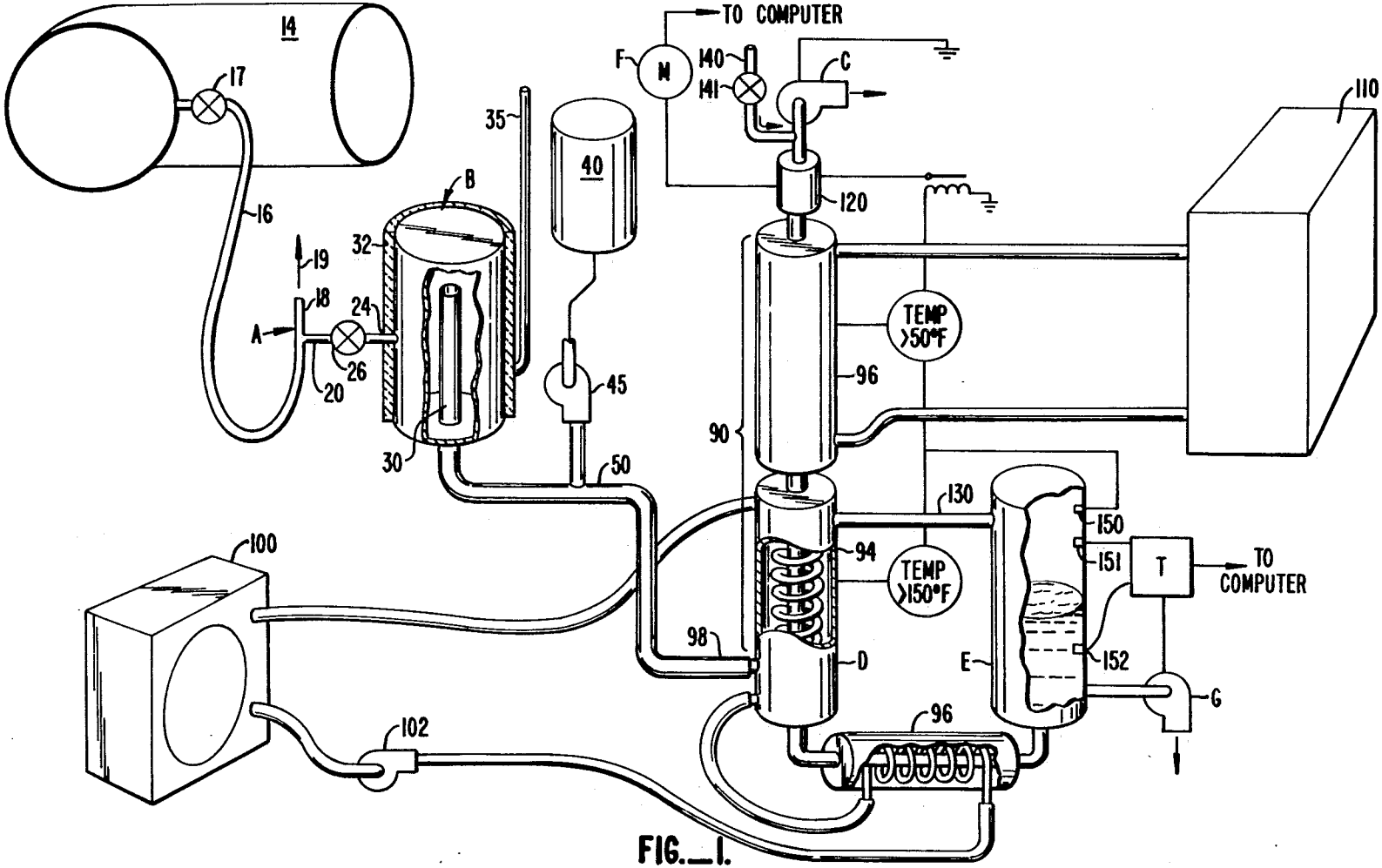
FIG. 1 is an overall schematic illustrating the construction in operation of this device.

Pressure in the main steam line will be that supplied by the geothermal field. For example, pressure of the main steam in the range of 150 lb./inch$^2$ can be accommodated. Typically, the steam is expanded through valve 17 to 30 times its normal volume. This being the case, pressure of the steam as it passes through the T separator is in the range of 5 lb./inch$^2$. The steam at this point is superheated; that is to say there is no liquid water within the steam.

At this juncture, the steam flows into pressure drop chamber B. This chamber is typically jacketed with insulation 32 interior of the chamber.

Interior of chamber B, there is a large vertical column 30. As will be more apparent, column 30 is the entrance to the vacuum system which produces the required measurement. Excess condensate and steam accumulated within the pressure drop chamber B are discharged through a pipe 35.

Referring to column 30, this column is the entrance of dry steam to the condensible gas measuring device of this invention. A vacuum pump C and a condenser D with well E will be seen to pull the measured fluids through the system. By measuring the flow of condensate out of well E against the flow of noncondensible gases through the vacuum pump C, measurement can occur.

Referring again to FIG. 1, an acid supply 40 is injected through a pump 45 into the passing steam flow 50 from the conduit 30. Sufficient injection occurs to give the overall flow a pH between 3.0 and 5.0 preferably to the range of 4.0. When the sulfuric acid is injected in dilute form, it changes the pH of the passing condensate. This prevents hydrogen sulfide and carbon dioxide from dissolving in the condensate.

Ammonia ($NH_3$) will in fact dissolve in the condensate. As will hereinafter be made apparent, a correction factor can be made for the noncondensible ammonia by measuring the ammonia in the condensate and correcting the gas flow computation.

The treated saturated steam is then passed to a vertical condenser 90.

Condenser 90 is divided into two component parts. It has a lower pool 94 which is maintained as close to boiling as possible. It has an upper pool 96 which is maintained as close to freezing as is possible. The purposes of the temperature extremes can now be understood.

Lower pool 94 is cooled by a heat exchanger 100. Heat exchanger 100 has a circulating pump 102 passing a cooling fluid such as antifreeze continuously through a lower condenser 96 and the lower column 94. Typically, the antifreeze passes in a counterflow disposition through lower condenser 96 and then through lower pool 94 with recirculation to an atmospheric heat exchanger 100. Lower column 94 has an inlet 98 at the bottom thereof. Consequently, steam entering the lower column 94 discharges upwardly against any standing condensate. It is found that such a flow assists in the discharge of gas from the condensate solution by stripping dissolved gases from the downwardly flowing condensate.

Upper column 96 is refrigerated. This column is connected to a refrigeration unit 110 and is maintained preferably close to the freezing point of water.

At this point, the reader will understand that dry gas will be discharged from the top of the column 96 at a mass flow meter measurement indicator 120. At the same time, condensate only will be displaced towards well E. By measuring the volume of gases at flow meter 120 and comparing these gases to the condensate discharged through well E, the desired ratio is obtained.

In order to keep the condensate interior of lower column 94 and well E at the same level, an equalizing line 130 is utilized. This line equalizes the pressure in the two vessels.

Vacuum pump C is typically provided with a small air flow through a line 140. This air flow enables the pump head to remain dry and not burn out. Where calibration of the unit is occurring, line 140 is closed at a valve 141.

At this juncture, the reader can note for FIG. 1 so-called "fail safe" parameters.

First, all noncondensible gases are pulled through the system by the vacuum pump C. Typically, this pump operates at a "negative" pressure of about −25 (minus) inches of mercury. Downstream of vacuum pump C, a gas chromatograph or other analytical instrument can be attached.

Secondly, the system is provided with two temperature trips. Where the upper refrigerated column reaches a temperature exceeding 50° F., the system shuts down. Inaccurate measurement could be expected above this trip temperature.

Additionally, and where the lower well reaches a temperature in excess of 150° F., the system again shuts down. Boil over of water vapor into the gas measuring apparatus could well be expected under such circumstances.

Finally, the well E is provided with an upper level sensor 150 in addition to two regular upper and lower level sensors 151 and 152. The unit shuts down when the reservoir becomes flooded.

Having set forth the system, the simple operation can now be set forth.

Typically, the mass flow meter 120 outputs through a digital to analog converter F to a computer such as a Hewlett-Packard HP71 manufactured by the Hewlett-Packard Corporation of Palo Alto, Calif. Likewise, the time between the condensate pump G runs is output to the same computer. Output of the ratio of noncondensible gas to steam results. The flow rate of gases through the mass flow meter 120 is averaged by the computer over the time interval that elapses while well E fills with condensate. This time interval is directly proportional to the average condensate flow rate.

There is attached hereto a computer program in the BASIC language suitable to run on a $HP_{71}$ computer. This computer can be equipped with a disk drive to record results and a "Think Jet" printer, manufactured by and a Registered Trademark of the Hewlett-Packard Corporation of Palo Alto, Calif. Provision is made in the program to numerically and graphically record data from the disk drive to a printed out format. Measurements on the order of 2 to 3 minutes are made.

```
10 REM       TEST2C
20 REM
30 REM PROGRAM TO PROVIDE INSTANTANIOUS READOUT OF VOLTAGES
40 REM FOR BOTH CHANNELS OF GAS TO STEAM MONITOR
50 REM
60 REM FIX DECIMAL POINT TO FIVE PLACES
70 FIX 5
80 REM
90 REM SET CALIBRATION CONSTANT FOR ADC-41
100 C0=.000099984
110 REM
120 REM MAIN PROGRAM LOOP
130 'LOOP':
140 REM
150 REM PREPARE ADC-41 TO READ CHANNEL 0
160 OUTPUT :INTRFCE USING "#,B";NUM("0")
170 REM TRIGGER INTERFACE READ
180 TRIGGER :INTRFCE
190 REM INPUT NUMBER FROM ADC-41
200 ENTER :INTRFCE USING "5D";A
210 REM CONVERT ADC-41 NUMBER TO VOLTAGE
220 A=A*C0
230 REM
240 REM PREPARE ADC-41 TO READ CHANNEL 5
250 OUTPUT :INTRFCE USING "#,B";NUM("5")
260 REM TRIGGER INTERFACE READ
270 TRIGGER :INTRFCE
280 REM INPUT NUMBER FROM ADC-41
290 ENTER :INTRFCE USING "5D";B
300 REM CONVERT ADC-41 NUMBER TO VOLTAGE
310 B=B*C0
320 REM
330 REM DISPLAY VOLTAGES FOR BOTH CHANNELS
340 DISP A;"    ";B
350 REM
360 REM RESTART MAIN PROGRAM LOOP
370 GOTO 'LOOP'
```

```
10 REM                    GSTHINK
20 REM ************************************************************
30 REM HP-71B PROGRAM FOR GAS TO STEAM MONITOR
40 REM DATA MANAGEMENT. THIS VERSION ASSUMES
50 REM A MASS FLOW SENSOR FOR THE GAS AND A CHAMBER
60 REM OF KNOWN VOLUME FILLING FOR CONDENSED STEAM FLOW
70 REM ************************************************************
80 REM INSURES DATA CHANNEL #1 IS CLOSED TO PREVENT
90 REM OVERWRITE OF DATA
100 REM ***********************************************************
110 ASSIGN #1 TO *
120 REM ************************************************************
```

```
130 REM ALLOWS THE USER TO BYPASS THE PARAMETER ENTRY IF WARM RESTART
140 REM ************************************************************
150 INPUT "NEW PARAMETERS Y/N ";Z$
160 IF Z$#"Y" THEN GOTO 540
170 REM ************************************************************
180 REM RESETS ALL VARIABLES TO ZERO
190 REM ************************************************************
200 DESTROY ALL
210 REM ************************************************************
220 REM INPUT  OF VARIABLE PARAMETERS
230 REM ************************************************************
240 INPUT "DECIMAL FIX: ";F
250 FIX F
260 REM ************************************************************
270 REM UNITS FOR GRAPH
280 REM ************************************************************
290 INPUT "UNITS: ";U$
300 REM ************************************************************
310 REM ADC-41 CALIBRATION CONSTANT
320 REM ************************************************************
330 C0=.000099984
340 REM ************************************************************
350 REM SET SCALE FOR GRAPH
360 REM ************************************************************
370 INPUT "SCALE MULT: ";S
380 IF S<>1 AND S<>10 AND S<>100 THEN 370
390 INPUT "GAS SLOPE: ";S1
400 INPUT "GAS INTERCEPT: ";I1
410 REM ************************************************************
420 REM NUMBER OF LOOPS TO STORE ON DISK BEFORE PRINTING AVERAGE
430 REM ************************************************************
440 INPUT "# COND LOOPS :";L5
450 INPUT "COND VOL: ";O1
460 INPUT "ACID FLOW: ";A5
470 INPUT "ADD GAS FLOW: ";A1
480 INPUT "ADD FACT 1: ";F1
490 INPUT "MUL FACT 1: ";F2
500 INPUT "ADD FACT 2: ";F3
510 REM ************************************************************
520 REM CHECK DISK STATUS AND SET BLOCKS REMAINING
530 REM ************************************************************
540 INPUT "NEW DISK ? Y/N ";X$
550 IF X$#"N" THEN A9=60 ELSE INPUT "BLOCKS LEFT ON DISK";A9
560 REM ************************************************************
570 REM INITIALIZE NECESSARY VARIABLES
580 REM ************************************************************
590 Q=0 @ N=0 @ C9=0 @ E9=1 @ C1=0 @ V6=0 @ L4=0 @ Y6=0 @ V=1
600 REM ************************************************************
610 REM DIMENSIONS STRING AT 50 CHARACTERS FOR DISK ROUTINE

1200 OUTPUT :INTRFCE USING "#,B";NUM("5")
1210 TRIGGER :INTRFCE
1220 ENTER :INTRFCE USING "5D";V3
1230 REM ************************************************************
1240 REM DETERMINE IF NUMBER REPRESENTS A NEGATIVE VOLUME
1250 REM IF SO CONVERT TO POSITIVE VALUE
1260 REM ************************************************************
1270 V4=V3/10000
```

```
620 REM ************************************************************
630 DIM J$[50]
640 REM ************************************************************
650 REM CREATE DISK FILE AND OPEN DATA CHANNEL #1 TO THIS FILE
660 REM ************************************************************
670 N$="G"&DATE$[4,5]&TIME$[1,2]&TIME$[4,5]&":3"
680 CREATE TEXT N$,5000
690 ASSIGN #1 TO N$
700 REM ************************************************************
710 REM MAIN PROGRAM LOOP
720 REM ************************************************************
730 'LOOP0':
740 REM ************************************************************
750 REM PREPARE ADC-41 TO READ CHANNEL 0,TRIGGER READ,
760 REM AND INPUT VALUE USING ONLY FIRST TWO DIGITS AS A,B
770 REM (SEE ADC-41 MANUAL FOR ADC NUMBER FORMAT)
780 REM ************************************************************
790 OUTPUT :INTRFCE USING "#,B";NUM("0")
800 TRIGGER :INTRFCE
810 ENTER :INTRFCE USING "D,D,XXX";A,B
820 REM ************************************************************
830 REM SET CHANNEL 0 SWITCH TO 0 AND DISPLAY TO OFF
840 REM ************************************************************
850 V0=0 @ P$=" OFF "
860 REM ************************************************************
870 REM IF CHANNEL 0 IS ON CHANGE SWITCH AND DISPLAY VARIABLES GOTO LABEL1
880 REM ************************************************************
890 IF A=1 OR A=3 THEN V0=1 @ P$=" ON  " @ GOTO 'LABEL1'
900 IF (A=0 OR A=2) AND B>3 THEN V0=1 @ P$=" ON  " @ GOTO 'LABEL1'
910 REM ************************************************************
920 REM IF CHANNEL 0 WAS OFF LAST READ GOTO LABEL0
930 REM ************************************************************
940 IF NOT V THEN 'LABEL0'
950 REM ************************************************************
960 REM START TIMING,SET LAST READ TO OFF,GOTO 'DISK'
970 REM ************************************************************
980 T=TIME @ V=0 @ GOTO 'DISK'
990 REM ************************************************************
1000 REM BLOCK TO RUN IF CHANNEL 0 IS ON NOW
1010 REM ************************************************************
1020 'LABEL1':
1030 REM ************************************************************
1040 REM IF CHANNEL 0 WAS ON LAST READ GOTO LABEL0
1050 REM ************************************************************
1060 IF V THEN 'LABEL0'
1070 REM ************************************************************
1080 REM IF CHANNEL 0 WAS OFF LAST READ IT JUST CAME ON
1090 REM TAKE TIME AND CALCULATE FILL TIME,SET LAST READ TO ON
1100 REM ************************************************************
1110 Z=TIME-T @ V=1
1120 REM ************************************************************
1130 REM BLOCK TO READ CHANNEL 5
1140 REM ************************************************************
1150 'LABEL0':
1160 REM ************************************************************
1170 REM PREPARE ADC-41 TO READ CHANNEL 5,TRIGGER READ,INPUT VALUES
1180 REM USING ALL 5 DIGITS
1190 REM ************************************************************
```

```
1280 IF IP(V4)=3 THEN V3=-10000*(1+FP(V4))
1290 IF IP(V4)=2 THEN V3=-10000*FP(V4)
1300 REM ************************************************************
1310 REM CONVERT ADC-40 NUMBER TO CALCULATED VALUE
1320 REM ************************************************************
1330 V3=V3*C0*S1+I1+A1
1340 REM ************************************************************
1350 REM DISPLAY TIME,PUMP STATUS,GAS FLOW
1360 REM ************************************************************
1370 DISP TIME$;P$;V3
1380 REM ************************************************************
1390 REM AVERAGING OF GAS VALUES
1400 REM ************************************************************
1410 V6=V6+V3
1420 C1=C1+1
1430 REM ************************************************************
1440 REM BACK TO START OF MAIN LOOP
1450 REM ************************************************************
1460 GOTO 'LOOP0'
1470 REM ************************************************************
1480 REM PRINT ROUTINE
1490 REM ************************************************************
1500 'PRINT':
1510 G=Y6/L5
1520 REM ************************************************************
1530 REM DETERMINE IF  NEW PAGE OR GRAPH SCALE ARE NEEDED
1540 REM ************************************************************
1550 IF Q=0 THEN 'PAGE'
1560 IF Q>=52 THEN N=1 @ Q=0 @ GOTO 'PAGE'
1570 IF G<=L1 OR G>=L2 THEN PRINT @ PRINT @ Q=Q+5 @ GOTO 'PAGE'
1580 REM ************************************************************
1590 REM PLOT ROUTINE
1600 REM ************************************************************
1610 'PLOT':
1620 G1=G/S
1630 L3=L1/S
1640 D1=G1-L3+26
1650 PRINT TIME$;"    ";G;TAB(D1);CHR$(252)
1660 Q=Q+1 @ N=0 @ L4=0 @ Y6=0
1670 GOTO 'LABEL0'
1680 REM ************************************************************
1690 REM DETERMINE SCALE FOR GRAPH AND PRINT HEADING
1700 REM ************************************************************
1710 'PAGE':
1720 IF N THEN PRINT CHR$(12)
1730 IF G>L1 AND G<L2 THEN 'PAGE3'
1740 J=0 @ I=G
1750 'PAGE2':
1760 IF I<10 THEN 'HEAD'
1770 I=I/10
1780 J=J+1
1790 GOTO 'PAGE2'
1800 'HEAD':
1810 J1=10^(-J)
1820 Z1=25*S*J1
1830 G9=G-MOD(G,5*S)
1840 L1=(G9*J1-Z1)/J1
1850 L2=(G9*J1+Z1)/J1
```

```
1860 'PAGE3':
1870 FIX 0
1880 PRINT DATE$;TAB(10);A9;" DISK BLOCKS REMAINING";TAB(47);U$
1890 PRINT TAB(24);L1;TAB(49);(L2-L1)/2+L1;TAB(74);L2
1900 PRINT TAB(26);"+";
1910 FOR K=1 TO 10
1920 PRINT "-----+";
1930 NEXT K

1940 PRINT
1950 FIX F
1960 GOTO 'PLOT'
1970 REM ************************************************************
1980 REM DISK FILE CLOSE ROUTINE
1990 REM CLOSES FULL FILES AND OPENS A NEW FILE,DECREMENTS BLOCK COUNTER
2000 REM ************************************************************
2010 'CLOSE':
2020 ASSIGN #1 TO *
2030 N$="G"&DATE$[4,5]&TIME$[1,2]&TIME$[4,5]&":3"
2040 CREATE TEXT N$,5000
2050 ASSIGN #1 TO N$
2060 E9=1 @ A9=A9-1
2070 RETURN
2080 REM ************************************************************
2090 REM DISK ACCESS ROUTINE
2100 REM CALCULATES GAS TO STEAM RATIO ANS PUTS DATE,TIME,
2110 REM GAS TO STEAM RATIO,CONDENSATE FLOW,AND GAS FLOW
2120 REM IN DISK FILE
2130 REM ************************************************************
2140 'DISK':
2150 IF NOT C9 THEN C9=1 @ V6=0 @ C1=0 @ GOTO 'LOOP0'
2160 IF Z<0 THEN Z=Z+86400
2170 F8=O1/(Z/60)-A5
2180 R=V6/C1/F8
2190 G=(R+F1)*F2+F3
2200 Y6=Y6+G
2210 FIX 2
2220 J$=DATE$&","&TIME$&","&STR$(G)&","&STR$(F8)&","&STR$(V6/C1)
2230 PRINT #1;J$
2240 FIX F
2250 E9=E9+1 @ C1=0 @ V6=0 @ L4=L4+1
2260 REM ************************************************************
2270 REM IF FILE FULL CALL CLOSE SUBRUOTINE
2280 REM ************************************************************
2290 IF E9>=101 THEN GOSUB 'CLOSE'
2300 REM ************************************************************
2310 REM IF REQUIRED NUMBER OF LOOPS FINISHED PRINT AND PLOT AVERAGE
2320 IF L4>=L5 THEN 'PRINT'
2330 REM ************************************************************
2340 REM RETURN  TO MAIN LOOP
2350 REM ************************************************************
2360 REM ************************************************************
2370 GOTO 'LOOP0'
```

```
10 REM      CALIB
20 REM
30 REM PROGRAM FOR USE IN CALIBRATING GAS FLOW SENSOR
40 REM FOR THE GAS TO STEAM MONITOR
50 REM
60 REM RESET ALL VARIABLES TO ZERO
70 DESTROY ALL
80 REM
90 REM FIX DECIMAL POINT TO THREE PLACES
100 FIX 3
110 REM
120 REM CALIBRATION CONSTANT FOR ADC-41
130 C0=.000099984
140 REM
150 REM INPUT FOR DISPLAY ADJUSTMENT FACTORS
160 INPUT "SLOPE: ";S
170 INPUT "INTERCEPT: ";I
180 REM
190 REM MAIN PROGRAM LOOP
200 'LABEL0':
210 REM
220 REM PREPARE ADC-41 TO READ CHANNEL 0
230 OUTPUT :INTRFCE USING "#,B";NUM("5")
240 REM TRIGGER ADC-41 READ
250 TRIGGER :INTRFCE
260 REM INPUT NUMBER FROM ADC-41
270 ENTER :INTRFCE USING "5D";V
280 REM
290 REM DETERMINE IF ADC-41 NUMBER REPRESENTS A
300 REM NEGATIVE VOLTAGE AND IF SO CONVERT
310 REM TO A POSITIVE NUMBER
320 V1=V/10000
330 IF IP(V1)=3 THEN V=-10000*(1+FP(V1))
340 IF IP(V1)=2 THEN V=-10000*FP(V1)
350 REM
360 REM CONVERT ADC-41 NUMBER TO DESIRED DISPLAY NUMBER
370 V=V*C0*S+I
380 REM
390 REM CALCULATE RUNNING AVERAGE OF PREVIOUS READINGS
400 V2=V2+V
410 C=C+1
420 V0=V2/C
430 REM
440 REM DISPLAY RUNNING AVERAGE AND INSTANTANIOUS READING
450 DISP V0;"    ";V
460 REM
470 REM RESTART MAIN LOOP
480 GOTO 'LABEL0'
490 END
```

```
10 REM ************************************************************
20 REM                    DATAPLT
30 REM ************************************************************
40 Q=0 @ N=0
50 INPUT "PLOT SCALE ";S
60 IF S#1 AND S#10 AND S#100 THEN 50
```

```
70 DIM J$[50]
80 INPUT "# OF FILES TO PLOT ";T
90 DIM Z$(T)
100 FOR I=1 TO T
110 PRINT "NAME OF FILE ";I;
120 INPUT Z$(I)
130 NEXT I
140 FOR A=1 TO T
150 N$=Z$(A)&":2"
160 ASSIGN #1 TO N$
170 FOR B=1 TO 100
180 READ #1;J$
190 D$=J$[1,8]
200 T$=J$[10,17]
210 G=VAL(J$[19,25])
220 GOSUB 'PRINT'
230 NEXT B
240 ASSIGN #1 TO *
250 NEXT A
260 REM ************************************************************
270 REM PRINT ROUTINE
280 REM ************************************************************
290 'PRINT':
300 REM ************************************************************
310 REM DETERMINE IF  NEW PAGE OR GRAPH SCALE ARE NEEDED
320 REM ************************************************************
330 IF Q=0 THEN 'PAGE'
340 IF Q>=52 THEN N=1 @ Q=0 @ GOTO 'PAGE'
350 IF G<=L1 OR G>=L2 THEN PRINT @ PRINT @ Q=Q+5 @ GOTO 'PAGE'
360 REM ************************************************************
370 REM PLOT ROUTINE
380 REM ************************************************************
390 'PLOT':
400 G1=G/S
410 L3=L1/S
420 D1=G1-L3+26
430 PRINT T$;"    ";G;TAB(D1);CHR$(252)
440 Q=Q+1 @ N=0 @ L4=0 @ Y6=0
450 RETURN
460 REM ************************************************************
470 REM DETERMINE SCALE FOR GRAPH AND PRINT HEADING
480 REM ************************************************************
490 'PAGE':
500 IF N THEN PRINT CHR$(12)
510 IF G>L1 AND G<L2 THEN 'PAGE3'
520 J=0 @ I=G
530 'PAGE2':
540 IF I<10 THEN 'HEAD'
550 I=I/10
560 J=J+1
570 GOTO 'PAGE2'
580 'HEAD':
590 J1=10^(-J)
600 Z1=25*S*J1
610 G9=G-MOD(G,5*S)
620 L1=(G9*J1-Z1)/J1
630 L2=(G9*J1+Z1)/J1
```

```
640 'PAGE3':
650 FIX 0
660 PRINT D$;TAB(47);U$
670 PRINT TAB(24);L1;TAB(49);(L2-L1)/2+L1;TAB(74);L2
680 PRINT TAB(26);"+";
690 FOR K=1 TO•10
700 PRINT "----+";
710 NEXT K
720 PRINT
730 FIX F
740 GOTO 'PLOT'
750 END
```

What is claimed is:

1. Apparatus for measuring noncondensible gas in steam flow comprising:

separator means for separating condensate in saturated steam from steam;

an expansion chamber for expanding said saturated steam to superheat said steam;

a condenser column for receiving said superheated steam having a lower condensate pool and an upper gas discharge portion;

means for maintaining said lower condensate pool at a temperature approximating boiling;

means for maintaining the upper portion of said column at a temperature approaching freezing;

means for pulling under vacuum relative to atmosphere the noncondensible gases from the upper refrigerated portion of said column; and means for measuring noncondensible gases passing out of the refrigerated portion of said column;

means for measuring condensate accumulated at the bottom of said column whereby the ratio of noncondensible gases to condensate may be determined.

2. The apparatus of claim 1 and wherein said separator means comprises a T-joint steam line for causing said steam to undergo a right angle turn.

3. The apparatus of claim 1 and wherein said means for maintaining said lower condensate pool at a temperature approximating boiling includes an atmospheric cooler and a heat exchanger with heat exchanging fluid pumped through said lower condensate pool and said atmospheric cooler to discharge heat.

4. The apparatus of claim 1 and wherein said means for pulling under vacuum includes the suction side of a.,vacuum pump and further includes means for bleeding air into said vacuum pump.

5. A process of continually monitoring a stream of geothermal steam comprising the steps of:

sampling a representative quantity of said passing geothermal steam;

separating condensate out of said geothermal steam;

expanding said geothermal steam so as to super heat said steam;

separating the steam into noncondensible gases and condensate including condensing said condensate at a temperature approaching boiling and discharging said gases at a temperature approaching the freezing point of condensate;

measuring said discharged gases and measuring said discharged condensate to determine the ratio of noncondensible gases in said steam.

6. The process of claim 5 and wherein said separating out said condensate step includes the step of passing said steam through a mechanical separator.

7. The process of claim 5 and wherein the separating step includes bubbling introduced steam through said condensate.

8. The process of claim 5 and wherein said measuring said discharged condensate includes the steps of accumulating said condensate in said pool and measuring said accumulated condensate when it is discharged.

* * * * *